US008443877B1

(12) United States Patent
Keast

(10) Patent No.: US 8,443,877 B1
(45) Date of Patent: May 21, 2013

(54) DRILLING RIG WITH TOP DRIVE AND INSIDE BLOWOUT PREVENTER

(71) Applicant: Larry G. Keast, Houston, TX (US)

(72) Inventor: Larry G. Keast, Houston, TX (US)

( * ) Notice: Subject to any disclaimer, the term of this patent is extended or adjusted under 35 U.S.C. 154(b) by 0 days.

(21) Appl. No.: 13/725,541

(22) Filed: Dec. 21, 2012

(51) Int. Cl.
*E21B 19/00* (2006.01)

(52) U.S. Cl.
USPC ..... 166/77.1; 166/77.51; 166/332.3; 175/218

(58) Field of Classification Search
USPC ..... 166/77.1, 78.1, 86.1, 87.1, 332.3, 166/334.2; 175/218; 251/1.1
See application file for complete search history.

(56) References Cited

U.S. PATENT DOCUMENTS 3,887,161 A * 6/1975 Kubelka, Jr. ..... 251/58
4,535,852 A * 8/1985 Boyadjieff et al. ..... 175/170
4,576,358 A * 3/1986 Mott et al. ..... 251/14
5,507,467 A * 4/1996 Mott ..... 251/58
6,840,493 B2 * 1/2005 York et al. ..... 251/58
7,461,698 B2 * 12/2008 Klipstein ..... 166/332.4
2011/0226485 A1 * 9/2011 Seneviratne et al. ..... 166/373

* cited by examiner

*Primary Examiner* — David Andrews
*Assistant Examiner* — Richard Alker
(74) *Attorney, Agent, or Firm* — Buskop Law Group, PC; Wendy Buskop

(57) ABSTRACT

A drilling rig with a top drive having an inside blowout preventer for drilling in a wellbore, the drilling rig having a derrick and a crown, a torque track suspended from the crown, a travelling block hanging from a cable, a drawworks for raising or lowering the travelling block, and a top drive with a rotatable stem suspended from the travelling block. The top drive has a motor mounted to the top drive housing and is connected to the rotatable stem. An inside blowout preventer with a rotatable stem is connected to the top drive rotatable stem. The inside blowout preventer has a hydraulically actuatable arm, a hydraulic cylinder, a tubular body having a tubular bore, and a valve operator assembly surrounding the tubular body.

7 Claims, 8 Drawing Sheets

DRILLING RIG WITH TOP DRIVE AND INSIDE BLOWOUT PREVENTER

FIELD

The present embodiments generally relate to a drilling rig having a top drive with an inside blowout preventer.

BACKGROUND

A need exists for a drilling rig having a top drive with an inside blowout preventer to reduce the threat of blowouts through the drill pipe, while also reducing drilling mud waste on to the rig floor when breaking connections.

A need exists for a drilling rig with a top drive having a vertically positionable torque wrench assembly that has a hydraulic cylinder with a single hollow cylinder rod disposed therethrough and extending into protected areas, thereby reducing or eliminating the occurrence of axial movement of a flexible hydraulic conduit of the torque wrench assembly, and protecting the flexible hydraulic conduit from exterior forces.

A need exists for a drilling rig having a top drive with a torque wrench assembly that has a spring open feature, thereby reducing the need for an extra hydraulic conduit for use in opening the torque wrench assembly.

The present embodiments meet these needs.

BRIEF DESCRIPTION OF THE DRAWINGS

The detailed description will be better understood in conjunction with the accompanying drawings as follows.

Figure 1:
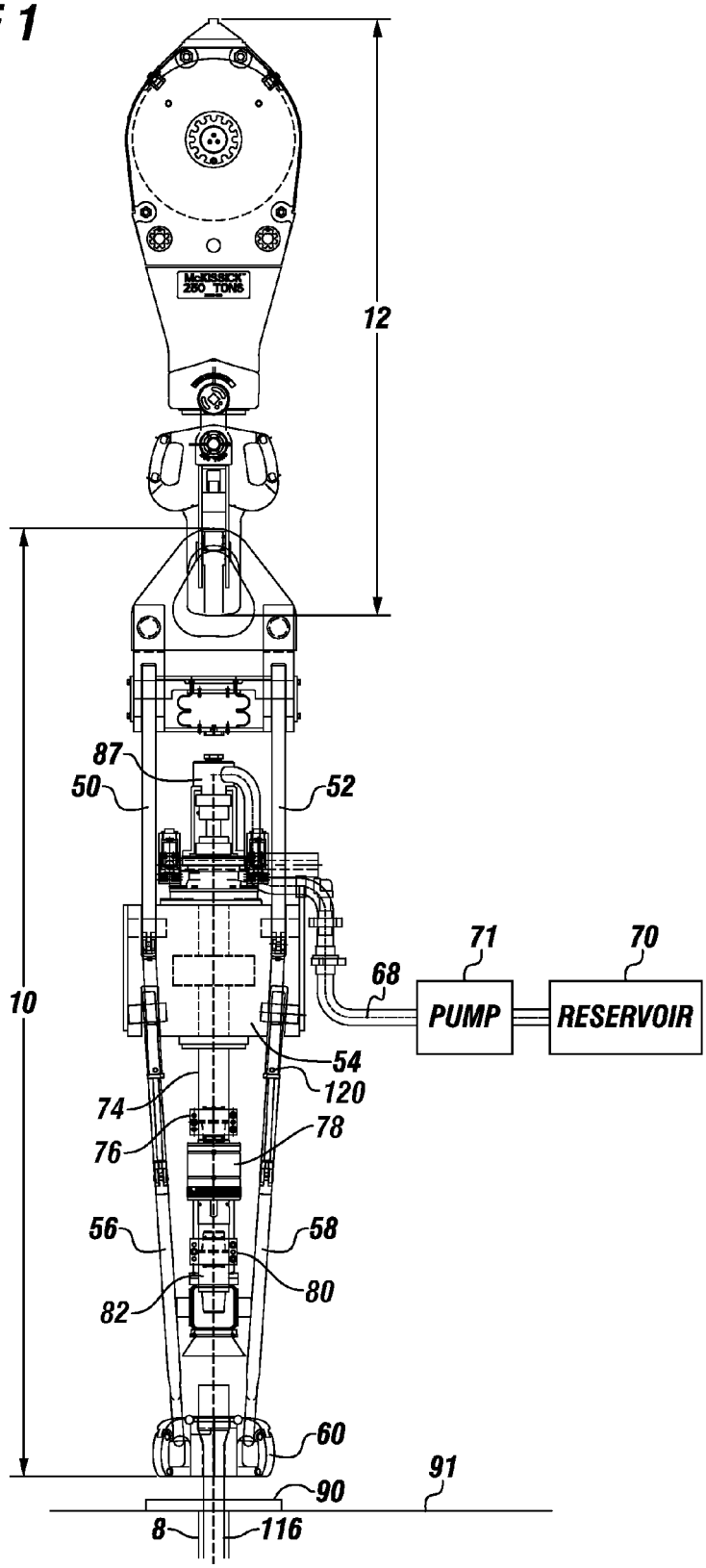
FIG. 1 is a front view of a top drive with a travelling block.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a drilling rig with a top drive having an inside blowout preventer for drilling in a wellbore.

The drilling rig can include a derrick having a crown and a torque track suspended from the crown, wherein a bottom of the torque track can be connected with a bottom of the drilling rig.

The drilling rig can include a hook secured to a cable, wherein the cable can extend from the hook over at least one sheave mounted to a top of the derrick and can be connected with a drawworks with a drawworks motor for turning the drawworks and raising or lowering the hook.

The drilling rig can include a top drive with a top drive housing connected with a pair of upper links, wherein the top drive can support a rotatable stem and a grabber leg.

The rotatable stem can be connected with the inside blowout preventer, which can comprise a hydraulically actuatable arm connected on a first end to the grabber leg and positionable on a second end between a retracted position and an extended position with a wheel assembly affixed to the second end.

The hydraulically actuatable arm can have a first end connected with the grabber leg. The hydraulically actuatable arm can also have a second end. The second end can have a wheel assembly located thereon.

The inside blowout preventer can include a spring return hydraulic cylinder assembly attached with the grabber leg for extending and retracting the hydraulically actuatable arm between a retracted position and an extended position. The hydraulically actuatable arm can be retracted using hydraulic force, spring force, or both. The hydraulic force can be generated by a hydraulic cylinder.

The inside blowout preventer can include a tubular body having a tubular bore. A manually operated ball valve and a hydraulically operated ball valve can be located in the tubular bore.

The inside blowout preventer can include a plurality of spring seats. The plurality of spring seats can extend away from the tubular body.

The inside blowout preventer can include a pair of operating levers. The pair of operating levers can be on opposing sides of the hydraulically operated ball valve for moving the hydraulically operated ball valve between an open position and a closed position.

The inside blowout preventer can include a valve operator assembly surrounding the tubular body around the hydraulically operated ball valve.

The valve operator assembly can include a first cover, a second cover, a plurality of valve assembly springs, and a plurality of centralizing wheel assemblies for centralizing the valve operator assembly axially along the tubular body as the hydraulically operated ball valve moves between the closed position and the open position.

Each valve assembly spring can be positioned between one spring seat of the plurality of spring seats and the first cover.

The closed position for the hydraulically operated ball valve can be achieved when the plurality of valve assembly springs are compressed by the hydraulically actuatable arm when pushed by the spring return hydraulic cylinder assembly.

The open position can be achieved when the spring return hydraulic cylinder assembly retracts, releasing force on the hydraulically actuatable arm allowing the plurality of valve assembly springs to extend.

The second end of the hydraulically actuatable arm can be retracted with a spring of the spring return hydraulic cylinder assembly away from the first cover to prevent rolling contact on the first cover during normal drilling operations.

The top drive can also include a motor connected with the rotatable stem and mounted to the top drive housing, a pair of lower links can be connected with the top drive housing, a torque wrench assembly can be connected with the top drive housing, and an elevator can be connected with the pair of lower links.

Turning now to the Figures, FIG. 1 depicts an embodiment of a top drive 10 engaged with a travelling block with a hook 12.

The top drive 10 can include a first upper link 50, a second upper link 52, a top drive housing 54 connected with the first upper link 50 and the second upper link 52, a first lower link 56 and a second lower link 58 connected with the top drive housing 54, and an elevator 60 connected with the first lower link 56 and the second lower link 58 for grabbing a tubular 116.

The top drive 10 can be used for engaging a tubular 116 which can be a drill pipe extending from a rig floor 90, through a rig floor sub structure 91, and into a wellbore 8.

The top drive 10 can include a pump 71 in fluid communication with a reservoir 70 for flowing pressurized mud 68 to a wash pipe packing seal assembly 87 connected with the top drive housing 54. The pressurized mud 68 can flow along a central mud flow path, such as to a drill bit that can be connected with the tubular 116.

A rotatable stem 74 of the top drive housing can be connected with an upper clamp assembly 76.

The inside blowout preventer 78 can be connected between the upper clamp assembly 76 and a lower clamp assembly 80.

Also depicted is the elevator hydraulic cylinder 120 that can allow the elevator 60 to kick out and retract.

A saver sub 82 can be connected between the elevator 60 and the lower clamp assembly 80.

Figure 2A:
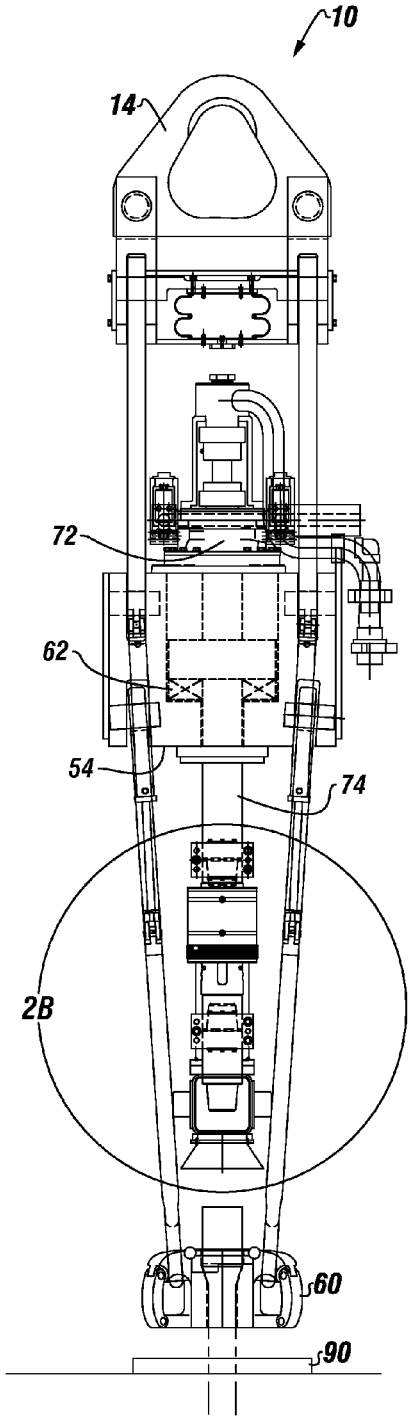
FIG. 2A is a front view of the top drive.
Figure 2B:
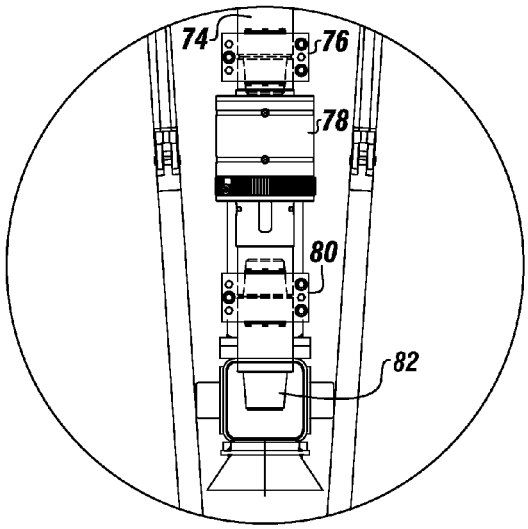
FIG. 2B is a detail view of an inside blowout preventer for the top drive of FIG. 2A.

FIGS. 2A and 2B depict an embodiment of the top drive 10 with an inside blowout preventer 78.

The top drive 10 can have a bail 14 that can be engaged with the travelling block with a hook, not shown in this Figure.

The top drive housing 54 can support a rotatable stem 74, which can be mounted therein. A motor 72 can be connected with the rotatable stem 74 and mounted to the top drive housing 54. A heavy thrust bearing 62 can be disposed about the rotatable stem 74 within the top drive housing 54. The elevator 60 is also shown.

An inside blowout preventer 78 can be connected with the rotatable stem 74 and to a saver sub 82. An upper clamp assembly 76 can be disposed about and can lock the connection between the rotatable stem 74 and the inside blowout preventer 78. A lower clamp assembly 80 can be disposed about and can lock the connection between the inside blowout preventer 78 and the saver sub 82. Also shown is the rig floor 90.

Figure 3A:
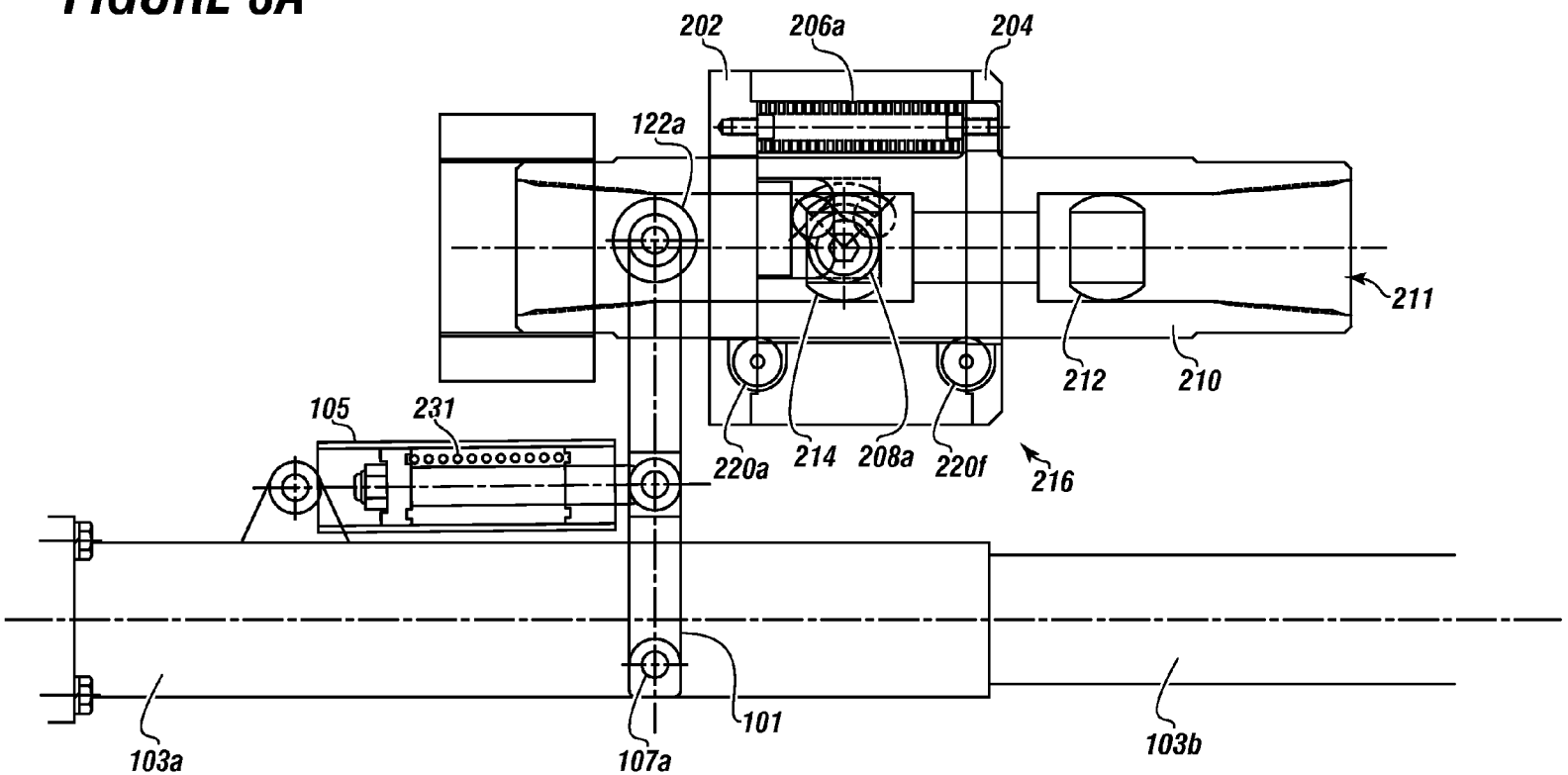
FIG. 3A is a detailed side view of the inside blowout preventer in a valve open position.

FIG. 3A is a detailed side view of the inside blowout preventer in a valve open position.

The inside blowout preventer can include a spring return hydraulic cylinder assembly 105 mounted to a grabber leg comprised of a grabber leg outer portion 103*a* and a grabber leg inner portion 103*b*. The spring return hydraulic cylinder assembly can contain a retraction spring 231.

The spring return hydraulic cylinder assembly 105 can have a rod on one end that attaches to an approximate midpoint of a hydraulically actuatable arm 101.

The hydraulically actuatable arm 101 can attach with the outer leg portion grabber leg portion 103*a*, such as with a pair of pivot pins. Pivot pin 107*a* can be seen in FIG. 3A. Both pivot pins 107*a* and 107*b* can be seen in FIG. 5A.

In an embodiment, the hydraulically actuatable arm 101 can have an H shape on a second end. At an end of the H shape can be a pair or rollers 122*a* and 122*b* shown in FIG. 5A. Roller 122*a* can be seen in FIG. 3A.

Between the first cover 202 and second cover 204 can be a plurality of valve assembly springs, one of which 206*a* is depicted in this view. Each valve assembly spring can be positioned between a spring seat 218 of FIG. 3B and the first cover 202.

The hydraulically actuatable arm 101 can compress the plurality of valve assembly springs, such as valve assembly spring 206*a*; when the rod of the spring return hydraulic cylinder assembly pushes the rollers 122*a* and 122*b* down on a first cover 202 of the valve operator assembly 216.

The valve operator assembly 216 surrounds a tubular body 210 with a tubular bore 211. A hydraulically operated ball valve 214 can be mounted in the tubular bore 211. A manually operated ball valve 212 in the tubular bore 211 can be aligned with the hydraulically operated ball valve 214.

The valve operator assembly 216 can include a first cover 202 and a second cover 204.

The closed position for the hydraulically operated ball valve can be achieved when the valve assembly springs are compressed by the hydraulically actuatable arm 101 when the arm is pushed by the spring return hydraulic cylinder assembly 105.

The open position can be achieved when the spring return hydraulic cylinder assembly 105 retracts, releasing force on the hydraulically actuatable arm 101 allowing the plurality of valve assembly springs to extend.

The hydraulically actuatable arm 101 can have a second end 110 (shown in FIG. 5A) is retracted using the spring of the spring return hydraulic cylinder assembly 105 away from the first cover 202 to prevent rolling contact on the first cover 202 during normal drilling operations.

Also shown are a plurality of centralizing wheel assemblies 220*a* and 220*f*.

In an embodiment, five of these centralizing wheel assemblies can be used adjacent the first cover, and five can be used adjacent the second cover.

The centralizing wheel assemblies can enable the valve operator assembly 216 to move axially along the tubular body 210 as the hydraulically operated ball valve 214 moves between the closed position and the open position.

A pair of operating levers can be positioned on opposing sides of the hydraulically operated ball valve 214 for moving the hydraulically operated ball valve 214 between an open position and a closed position. One of the operating levers, 208*a* can be viewed in this Figure.

Figure 3C:
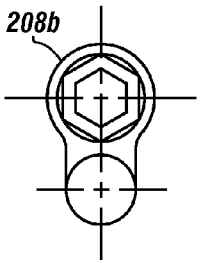
FIG. 3C is a top view of the second of the pair of operating levers.
Figure 3B:
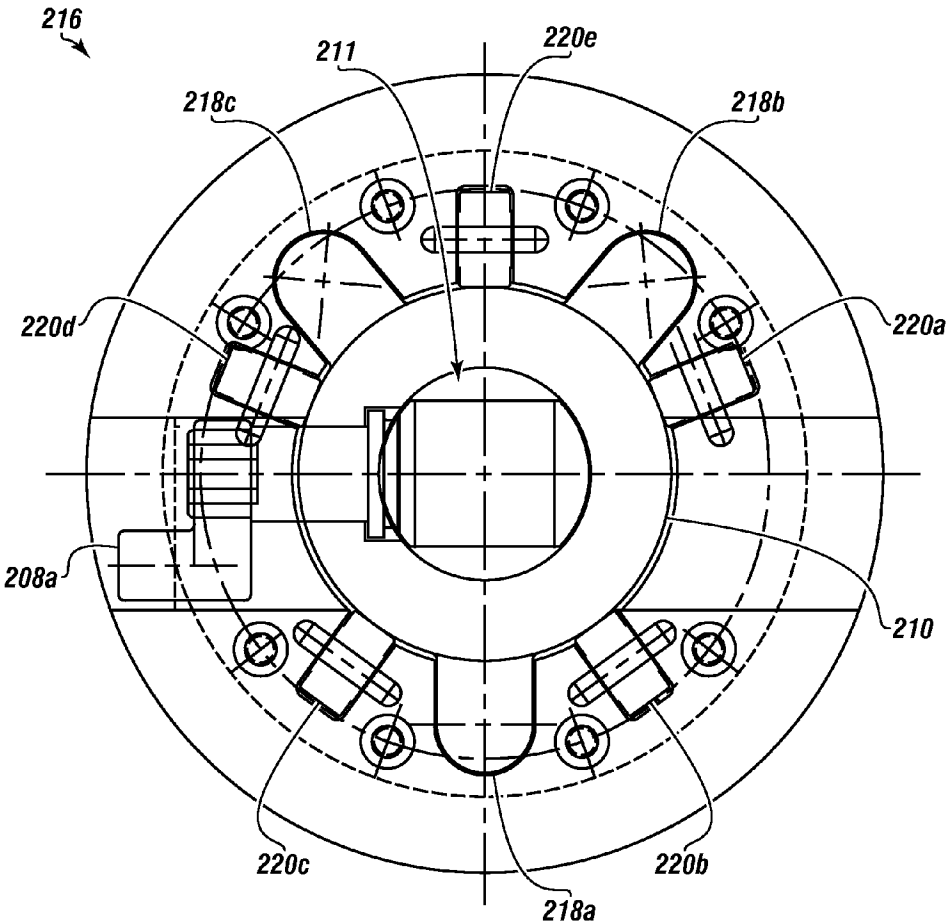
FIG. 3B is a cross sectional view of the valve operator assembly.

FIG. 3B is a cross sectional view of the valve operator assembly 216.

This Figure shows a tubular body 210 having a tubular bore 211.

The tubular bore 211, which can contain a manually operated ball valve aligned with a hydraulically operated ball valve, can also have a plurality of spring seats 218*a*, 218*b* and 218*c* extending away from the tubular body 210.

This figure shows one of the pairs of operating levers 208*a*. One of the pairs of operating levers is positioned on opposing sides of the hydraulically operated ball valve for moving the hydraulically operated ball valve between an open position and a closed position.

FIG. 3B also depicts a first group of the plurality of centralizing wheel assemblies 220*a*, 220*b*, 220*c*, 220*d* and 220*e* adjacent the first cover for frictionlessly rolling the valve operator assembly 216 axially along the tubular body 210 as the hydraulically operated ball valve moves between the closed position and the open position. Another group of five centralizing wheel assemblies can be positioned in the same manner opposite the second cover.

FIG. 3C is a top view of the second of the pair of operating levers 208*b*.

Figure 4:
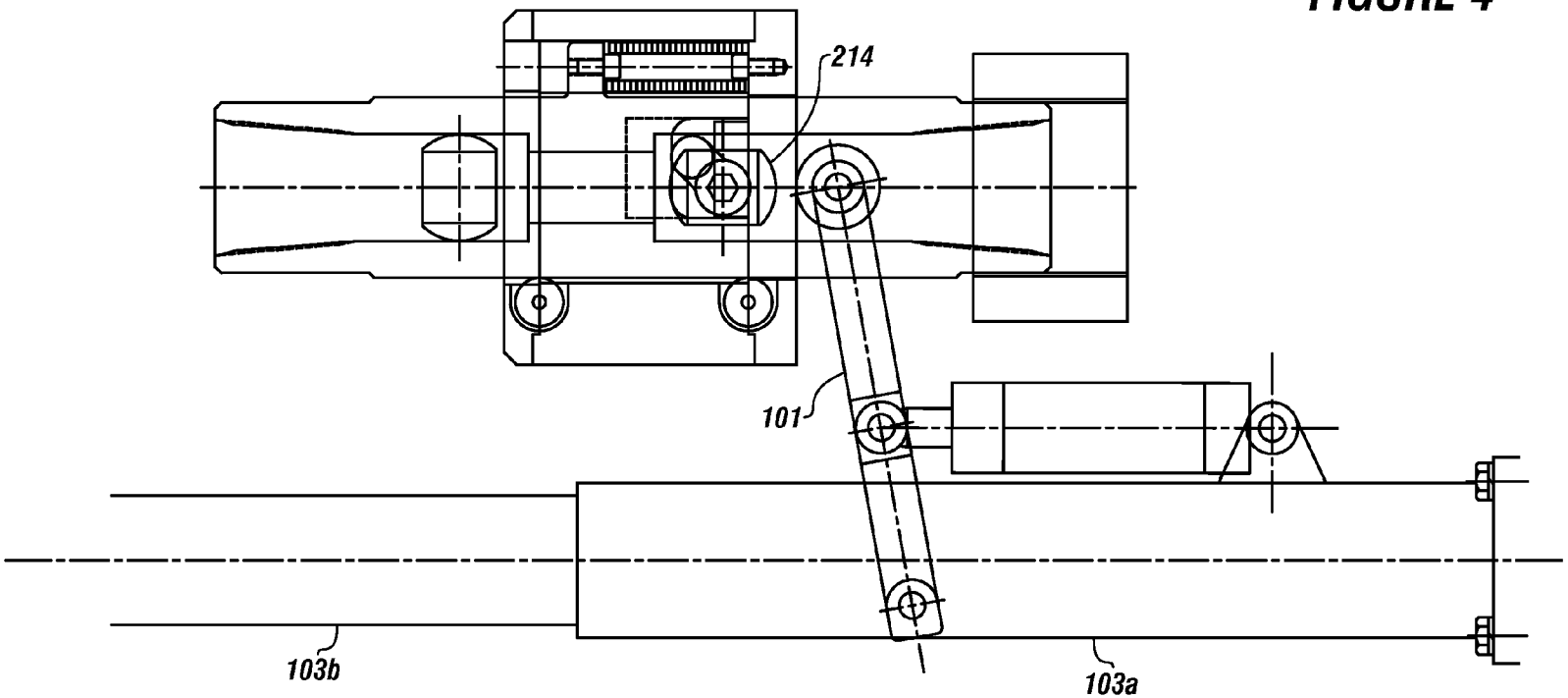
FIG. 4 is a detailed side view of the inside blowout preventer with a hydraulically operated ball valve in a closed position.

FIG. 4 is a detailed side view of the inside blowout preventer with a hydraulically operated ball valve in a closed position. The hydraulically actuatable arm 101 can be pivotably mounted to the grabber leg, which can be comprised of grabber leg outer portion 103*a* and grabber leg inner portion 103*b*, positioning the hydraulically operated ball valve 214 in the closed position.

Figure 5B:
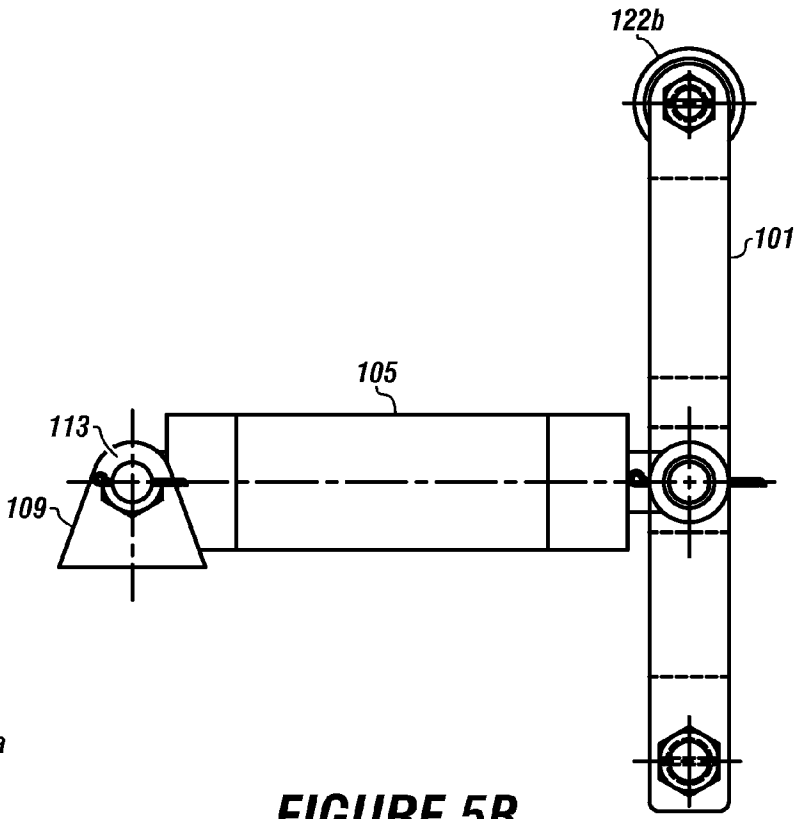
FIG. 5B is a side view of the hydraulically actuatable arm of FIG. 5A.
Figure 5A:
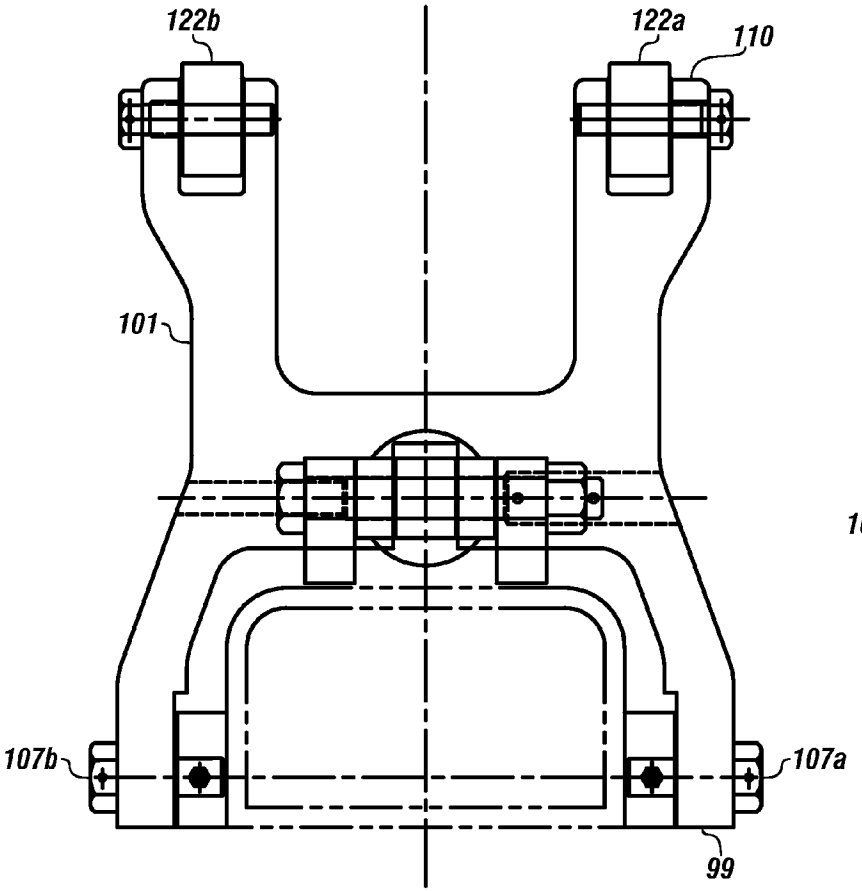
FIG. 5A is a top view of a hydraulically actuatable arm.

FIG. 5A is a top detailed view of a hydraulically actuatable arm 101.

The hydraulically actuatable arm 101 can include a pair of pivot pins 107*a* and 107*b* for attaching a first end 99 of the hydraulically actuatable arm 101 with the grabber leg. A pair of rollers 122*a* and 122*b* can be located on a second end 110 of the hydraulically actuatable arm 101.

FIG. 5B is a side view of the hydraulically actuatable arm 101 of FIG. 5A.

The spring return hydraulic cylinder assembly 105 can be connected with a pivot rod 113. The pivot rod 113 can attach to a mount 109. The mount 109 can connect with the grabber leg. The hydraulically actuatable arm 101 can be connected with the spring return hydraulic cylinder assembly 105.

One of the pair of rollers 122*b* is also shown.

Figure 6:
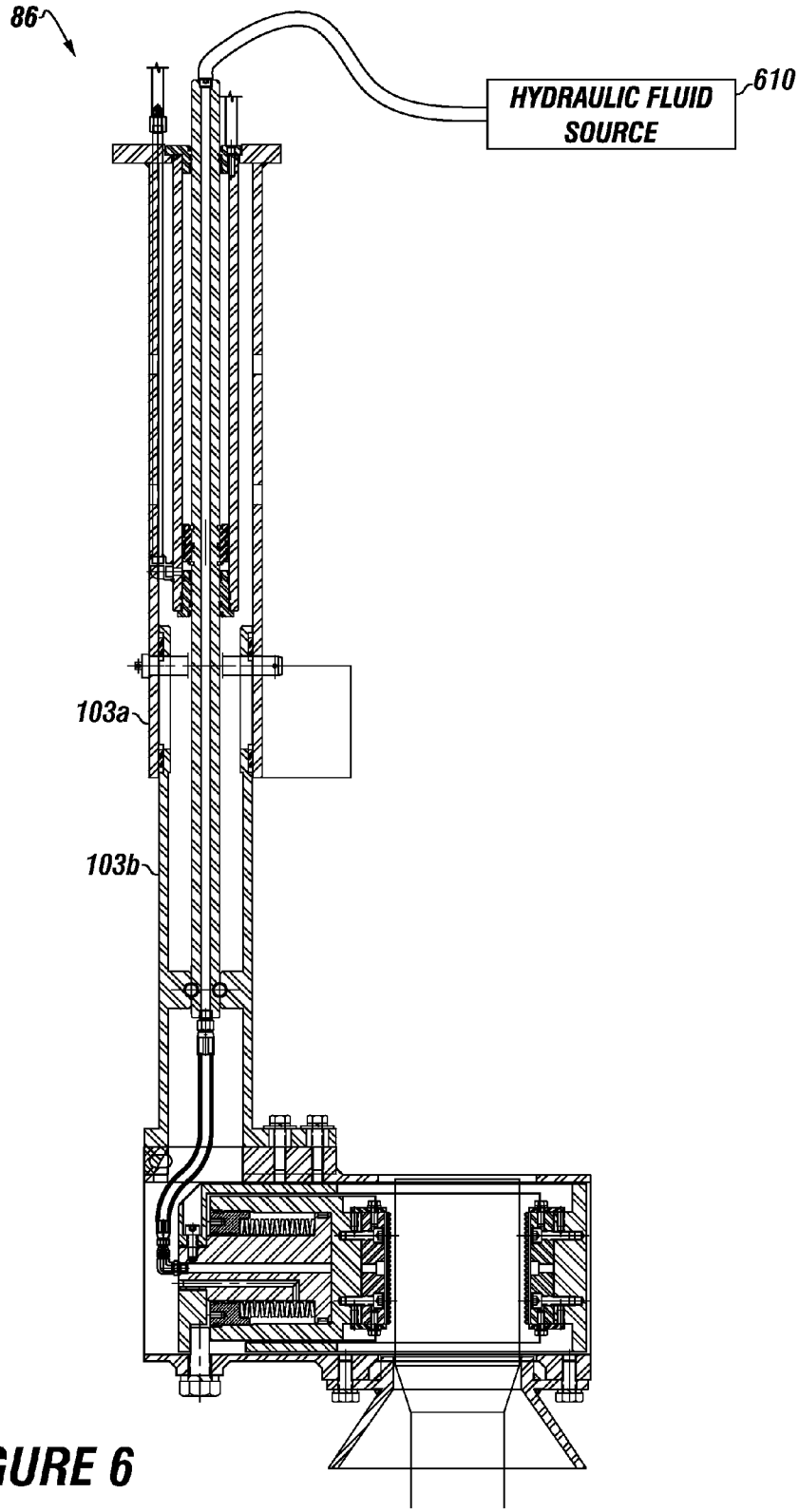
FIG. 6 depicts a detail of the torque wrench assembly.

FIG. 6 depicts a detailed view of the torque wrench assembly 86. The torque wrench assembly 86 can include a pair of torque supporting grabber legs consisting of a grabber leg outer portion 103*a* and a grabber leg inner portion 103*b*. The torque wrench assembly can be operatively connected with a hydraulic fluid source 610.

Figure 7:
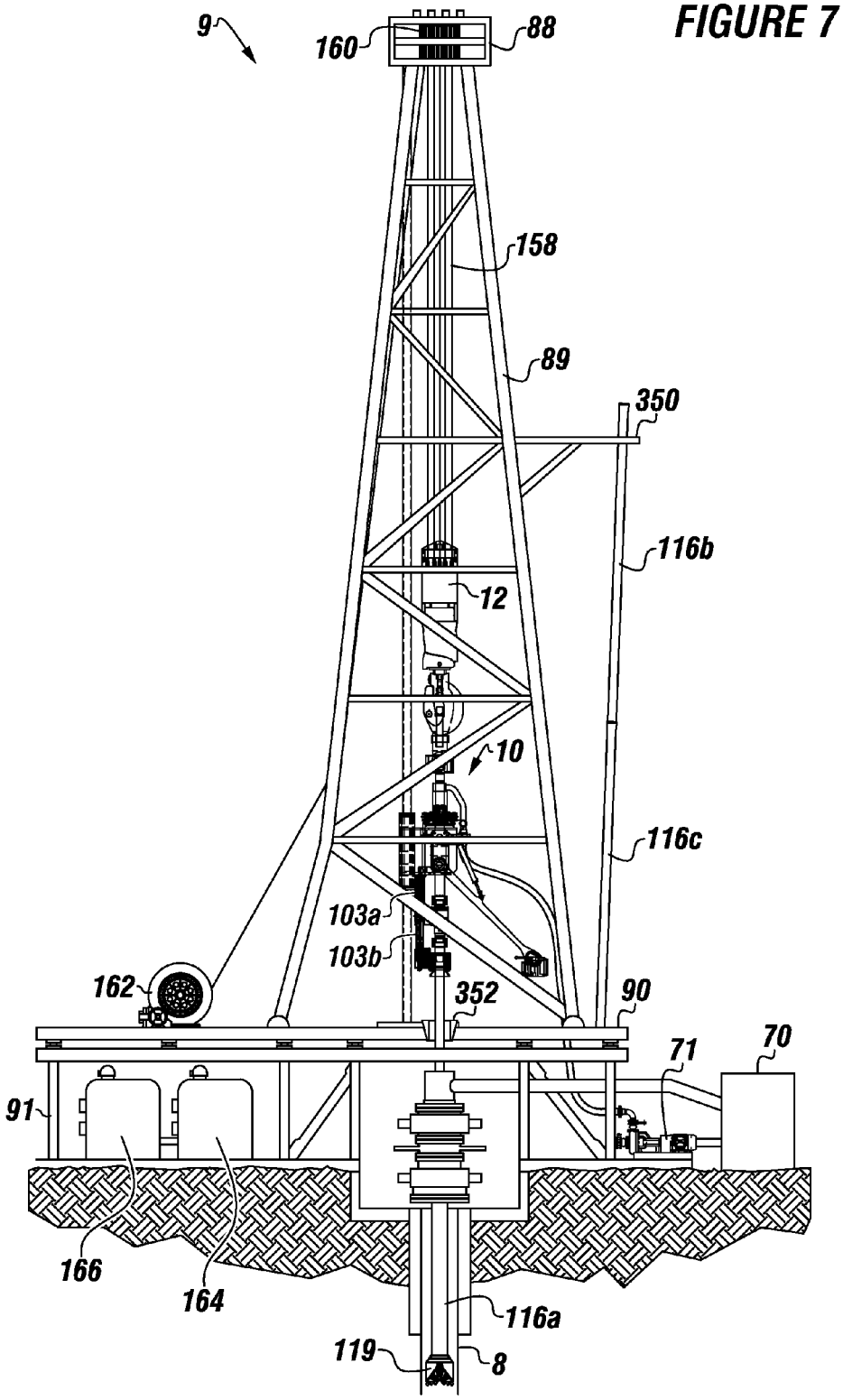
FIG. 7 is a side view of a rig with a top drive having an inside blowout preventer.

FIG. 7 depicts a drilling rig with a top drive 10 having an inside blowout preventer. The drilling rig 9 can include a derrick 89, a rig floor 90, and a rig floor substructure 91.

The travelling block with a hook 12 can be secured to a cable 158. The cable 158 can extend from the travelling block with a hook 12 over at least one sheave 160 mounted to a top of the derrick 89 at a crown 88.

The cable 158 can be connected with a drawworks 162. The drawworks 162 can be connected with a drawworks motor 164 for turning the drawworks 162, and for raising or lowering the travelling block with a hook 12.

The drawworks motor 164 can be energized from a power supply 166.

A first tubular 116*a* can be engaged with the top drive 10 at one end, and with a drill bit 119 on the other end.

Also depicted is a stand of tubulars, including a second tubular 116*b* and a third tubular 116*c*, which can be stacked in a racking position 350 on the rig floor 90.

The slips 352 of the drilling rig 9, the wellbore 8, the pump 71 and the reservoir 70 can also be seen in this Figure.

While these embodiments have been described with emphasis on the embodiments, it should be understood that within the scope of the appended claims, the embodiments might be practiced other than as specifically described herein.

What is claimed is:

1. A drilling rig with a top drive having an inside blowout preventer for drilling in a wellbore, the drilling rig comprising:

(a) a derrick having a crown;

(b) a torque track suspended from the crown, wherein a bottom of the torque track is connected with a bottom of the drilling rig;

(c) a hook secured to a cable, wherein the cable extends from the hook over at least one sheave mounted to a top of the derrick and is connected with a drawworks;

(d) a drawworks motor for turning the drawworks and raising or lowering the hook;

(e) a top drive housing connected with a first upper link and a second upper link, wherein the top drive supports a rotatable stem and a grabber leg;

(f) the inside blowout preventer connected with the rotatable stem, the inside blowout preventer comprising:

(i) a hydraulically actuatable arm having a first end and a second end, wherein the first end is connected with the grabber leg, and wherein a wheel assembly is located on the second end;

(ii) a spring return hydraulic cylinder assembly attached to the grabber leg for extending and retracting the hydraulically actuatable arm between a retracted position and an extended position, wherein the hydraulically actuatable arm is retracted to the retracted position by hydraulic force, spring force, or both;

(iii) a tubular body having a tubular bore, wherein the tubular body comprises:

(1) a manually operated ball valve in the tubular bore;

(2) a hydraulically operated ball valve in the tubular bore aligned with the manually operated ball valve;

(3) a plurality of spring seats extending away from the tubular body; and (4) a pair of operating levers on opposing sides of the hydraulically operated ball valve for moving the hydraulically operated ball valve between an open position and a closed position;

(iv) a valve operator assembly surrounding the tubular body around the hydraulically operated ball valve, wherein the valve operator assembly comprises:

(1) a first cover;

(2) a second cover; and (3) a plurality of valve assembly springs wherein each valve assembly spring is positioned between one spring seat of the plurality of spring seats and the first cover, wherein:

(a) the closed position for the hydraulically operated ball valve is achieved when the plurality of valve assembly springs is compressed by the hydraulically actuatable arm when pushed by the spring return hydraulic cylinder assembly; and (b) the open position is achieved when the spring return hydraulic cylinder assembly retracts, releasing force on the hydraulically actuatable arm allowing the plurality of valve assembly springs to extend; and (4) the second end of the hydraulically actuatable arm is retracted with a spring of the spring return hydraulic cylinder assembly away from the first cover to prevent rolling contact on the first cover during normal drilling operations; and (v) a plurality of centralizing wheel assemblies for rolling the valve operator assembly axially along the tubular body as the hydraulically operated ball valve moves between the closed position and the open position;

(g) a motor connected with the rotatable stem and mounted to the top drive housing;

(h) a first lower link and a second lower link each connected with the top drive housing;

(i) a torque wrench assembly connected with the top drive housing; and (j) an elevator connected with the first lower link and the second lower link.

2. The drilling rig of claim 1, wherein the first end of the hydraulically actuatable arm is connected with the grabber leg using a first pivot pin.

3. The drilling rig of claim 1, further comprising a mount secured to the grabber leg and the spring return hydraulic cylinder assembly.

4. The drilling rig of claim 1, wherein the spring return hydraulic cylinder assembly comprises a retraction spring to maintain the hydraulically actuatable arm with the wheel assembly apart from the first cover.

5. The drilling rig of claim 1, further comprising a saver sub connected with the inside blowout preventer.

6. The drilling rig of claim 1, further comprising:

(a) an upper clamp assembly disposed about the rotatable stem and the inside blowout preventer; and (b) a lower clamp assembly disposed about the inside blowout preventer and the saver sub.

7. The drilling rig of claim 1, further comprising an elevator hydraulic cylinder connected with the elevator for kicking out the elevator to grab tubulars.

* * * * *